US005813822A

United States Patent [19]

Pisco

[11] Patent Number: 5,813,822

[45] Date of Patent: Sep. 29, 1998

[54] BUCKET AND THUMB COMBINATION AS A QUICK DECOUPLING ATTACHMENT

[75] Inventor: Walter J. Pisco, Woodinville, Wash.

[73] Assignee: Pacific Services & Manufacturing, Woodinville, Wash.

[21] Appl. No.: 780,971

[22] Filed: Jan. 9, 1997

[51] Int. Cl.[6] ..... E02F 3/40

[52] U.S. Cl. ..... 414/723; 294/104

[58] Field of Search ..... 294/104; 414/694, 414/723, 704, 739

[56] References Cited

U.S. PATENT DOCUMENTS

| | | | |
|---|---|---|---|
| 3,003,265 | 10/1961 | Lutjens | 37/118 |
| 3,077,999 | 2/1963 | Svoboda . | |
| 3,273,729 | 9/1966 | Holopainen | 414/694 |
| 3,451,575 | 6/1969 | Petro, Jr. . | |
| 3,477,602 | 11/1969 | Peterson . | |
| 3,737,059 | 6/1973 | Peterson et al. . | |
| 4,214,840 | 7/1980 | Beales | 414/723 |
| 4,297,074 | 10/1981 | Ballinger | 414/723 |
| 4,413,945 | 11/1983 | LaBounty | 414/739 |
| 4,436,477 | 3/1984 | Lenertz et al. | 414/723 |
| 4,519,739 | 5/1985 | Risch | 414/724 |
| 4,674,945 | 6/1987 | Hulden | 414/723 |
| 4,761,113 | 8/1988 | Smith et al. | 414/732 |
| 4,804,309 | 2/1989 | Risch | 414/704 |
| 4,871,292 | 10/1989 | Milanowski | 414/723 |
| 4,890,974 | 1/1990 | Kistner | 414/723 |
| 4,907,356 | 3/1990 | Labounty | 37/117.5 |
| 5,024,010 | 6/1991 | Hulden | 37/118 R |
| 5,108,252 | 4/1992 | Gilmore, Jr. et al. | 414/694 |
| 5,332,353 | 7/1994 | Arnold | 414/723 |
| 5,423,625 | 6/1995 | Gebauer et al. | 403/322 |
| 5,431,528 | 7/1995 | Jenkins et al. | 414/723 |
| 5,494,396 | 2/1996 | Geier et al. | 414/723 |
| 5,544,435 | 8/1996 | Somero | 294/104 |

FOREIGN PATENT DOCUMENTS

WO 85/04440 of 0000 WIPO .

*Primary Examiner*—Karen M. Young
*Assistant Examiner*—Gregory A. Morse
*Attorney, Agent, or Firm*—Glenn D. Bellamy

[57] ABSTRACT

A two-part implement combination for attachment to an excavator arm in which both implement parts share a common axis of rotation relative to one another and relative to the excavator arm and are independently movable. This allows a bucket and thumb combination to be quickly coupled or decoupled as a unit from an excavator arm without sacrificing independence of movement and a common rotational arc.

6 Claims, 4 Drawing Sheets

BUCKET AND THUMB COMBINATION AS A QUICK DECOUPLING ATTACHMENT

TECHNICAL FIELD

The present invention relates to quick decoupling apparatus that is utilized in material handling equipment, such as is attached to the operating arm of an excavating machine or backhoe. More particularly, the invention relates to the use of such quick decoupling apparatus with a bucket and thumb combination or articulated attachment.

BACKGROUND OF THE INVENTION

Excavators consist of a machine with an extendable arm, known in the trade as a "dipper arm" or "dipper stick," onto which is attached an excavator bucket. The excavator bucket can take many forms, ranging from a simple backhoe bucket to a counteracting rake or grapple. This invention is directed to excavator attachments which may include a counteracting part such as a thumb. As a matter of convention, an excavator device such as a crane or backhoe is used to manipulate an excavator device such as a bucket, grapple or rake. Therefore, an excavator tool will be mounted to an excavator device, using a pivot and drive pin.

An operator of an excavator will likely want to use the excavator for a number of functions. These functions may require the use of different attachments. A some attachment, such as a bucket and thumb, must be removed and installed each time to enable use of such attachments. The attachments are often too heavy and cumbersome to be removed and installed easily on the dipper stick. Hence, a quick disconnect is used. A number of arrangements are made in order to provide for a quick disconnect of such excavator attachments.

A typical quick disconnect system consists of two plates, each having slots which are positioned longitudinally apart and oriented 90 degrees from one another. Examples of such prior art coupling devices are found in U.S. Pat. No. 5,423,625, to Gebauer et al. and U.S. Pat. No. 5,431,528 to Jenkins et al. An alternate coupling mechanism uses two pins in which one of the pins is locked into place after alignment of the dipper stick with the excavator tool. Examples of this mechanism are found in U.S. Pat. No. 5,024,010 to Hulden, and U.S. Pat. No. 5,494,396 to Gaior et al.

In the case of implements having a separate articulated attachment, such as a thumb, the quick disconnect does not provide for full detachment of the counter-articulated part (the thumb). In such a case, the counter-articulating part must be separately removed as it is mounted to the excavator around the quick coupling device using a pin. This becomes even more difficult in the case of attachment of the counter-articulating part because the hydraulic cylinder must be extended to an appropriate position or the counter-articulating part must be lifted. For this reason, replacement of attachments with counter-articulating parts is time consuming and difficult. It is not unusual for connection of a tool with a thumb to take twelve man hours.

It is desired to provide a quick coupling attachment for an excavator-type device, in which it is possible to simultaneously quick couple to a primary attachment and a counter-articulating part. It is desired to provide a quick coupling arrangement in which a first connection to a counter-articulating part is accomplished by effecting a connection of a primary part. It is desired that the counter-articulating part pivot about a common axis with the pivot of a primary excavator tool to the excavator device. It is desired that the quick coupling device accept as a single unit counter-articulating parts which are independently controllable, such as would be found in the case of an excavator bucket with a separately controllable thumb attachment. It is further desired that coupling and decoupling of excavator tools from an excavator's dipper stick be readily attached in a convenient manner as an assembly and that it not be necessary to separately attach an opposing part, except at a control actuator for the opposing part which is separately controllable when operating the excavator. It is further desired that such a coupling and decoupling system be able to accept an excavator tool in which a separately controllable counter-articulating part is not provided.

SUMMARY OF THE INVENTION

The present invention provides a two-part implement combination for attachment to an excavator arm. A releasable quick coupling mechanism is pivotably attached to the excavator arm and actuated for pivotal movement relative to the arm about a first axis. A first implement part is attachable to the arm by the releasable quick coupling mechanism for pivotal movement relative to the arm about the first axis. A second implement part is pivotally attached to the first implement part for independently actuated pivotal movement relative to the first implement part and the arm about an axis substantially co-extensive with the first axis. In preferred form, the first implement part is an excavator bucket and the second implement part is a thumb.

According to the invention, an implement for attachment to an excavator machine is provided with a pivot attach rod supported between a pair of flange members. An additional set of flange members is used to support a counter-articulating part of the attachment. The second set of flange members is co-axial with the pivot pin of a dipper stick, thereby permitting the counter-articulating part to pivot about an axis which is substantially aligned with the pivot support pin. This permits a primary part and the counter-articulating part to pivot at substantially the same axis. The pivot support rod is part of a quick disconnect system, so that attachment of the primary part deflects attachment of the counter-articulating part at the pivot location.

In accordance with a requirement of the invention, the first set of flanges for attachment of the pivot support rod are spaced inwardly from the second set of flanges, and the counter-articulating part is pivotally attached to the primary part by a second set of flanges mounted outboard of the first set of flanges. This arrangement assures that the counter-articulating part is pivotally supported at two locations and that these locations are spaced apart, thereby providing lateral support along an axis of rotation. In a preferred embodiment, the outboard flanges are arranged in pairs, separate of the main mounting flanges so as not to interfere with the coupling device while still providing an attach point for the counter-articulating part.

In one configuration, the mounting of the counter-articulating part is used in a system in which a pair of normally opposed slots are augmented by a third slot or position. Two rods on the dipper stick fit into two of the normally opposed slots. The third slot faces outwardly, and generally in an opposite direction from a first set of outwardly facing slots. The third set of slots disengaged with a removable rod, which is bolted to the excavator tool. This allows the coupling attachment to function without any further latching mechanisms, thereby speeding the assembly and disassembly of the excavator bucket to the dipper stick.

A further aspect of the invention provides quick easy and safe method of coupling and decoupling a combined attachment. The quick change system permits coupling and decoupling of independently counter-articulating parts along with the implement.

The term "excavating tool" is used generically, since any of a number of tools designed to attach to a dipper stick can be used, ranging from clam shell buckets to various rakes, grapples and related mechanisms. It is further intended that the preferred embodiments also be usable with single piece excavator tools, which increases the versatility of the inventive coupling arrangement.

BRIEF DESCRIPTION OF THE DRAWINGS

FIG. 4 shows the coupling in an isometric view; FIG. 5 shows a top view and to FIG. 6 shows a side view.

DETAILED DESCRIPTION OF THE PREFERRED EMBODIMENTS

Figure 1:
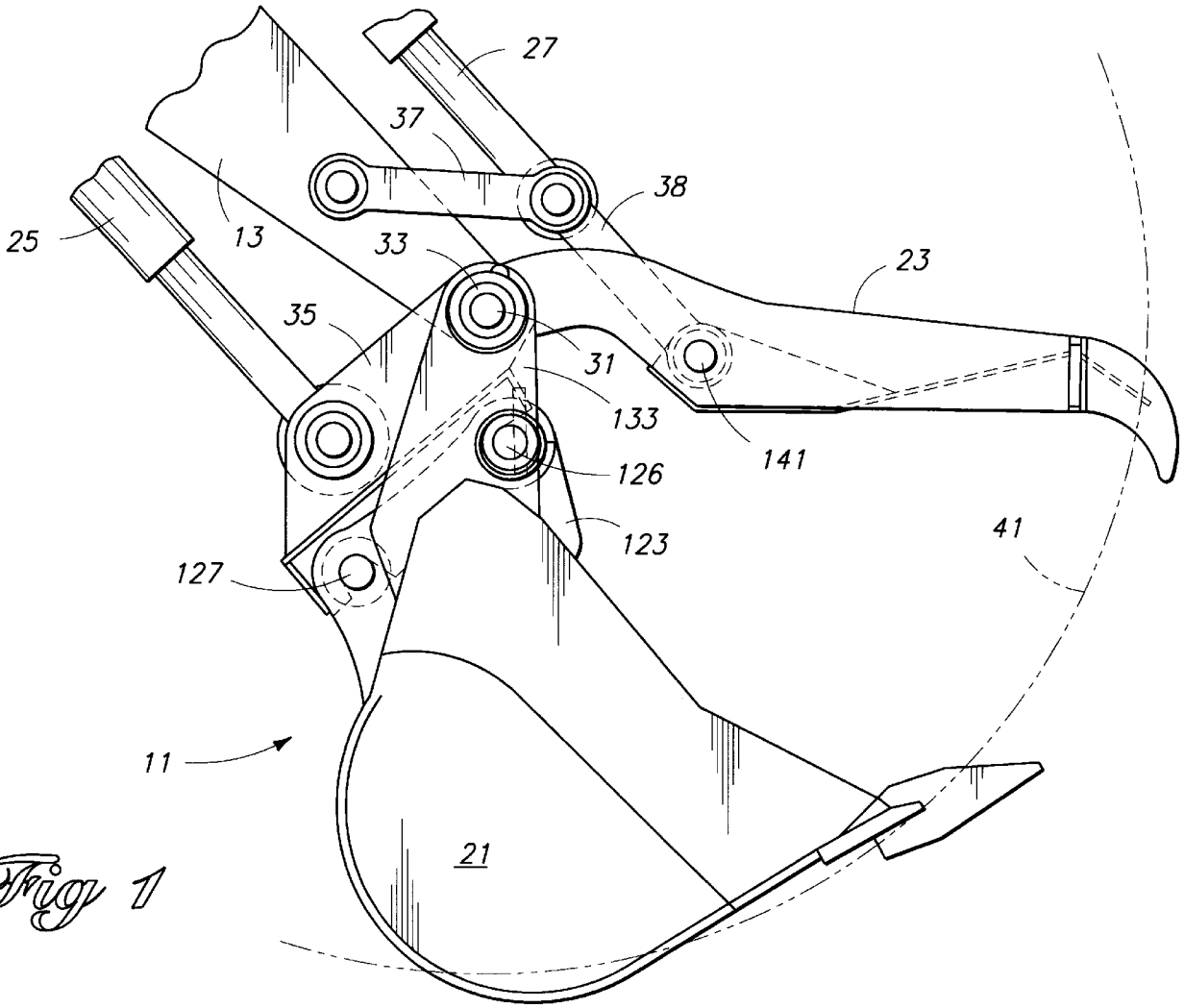
FIG. 1 shows a dipper stick with a combination excavator bucket and independently counter-articulating thumb attached to the dipper stick.

Referring to FIG. 1, an excavator tool 11 is removably attached to the end of a dipper stick 13, as part of heavy machinery used for excavation. The excavator tool 11 consists of an excavator bucket 21 and a thumb 23. The bucket 21 and thumb 23 articulate with respect to the dipper stick 13 and with respect to each other. This allows the thumb 23 to close against the bucket 21, so that the thumb 23 can counter-articulate against the bucket 21. This is accomplished by a pair of hydraulic actuators 25, 27.

The bucket 21 and thumb 23 both articulate by pivoting about a common pivot axis 31. a pivot pin 33 on the dipper stick 13 coincides with the common pivot axis 31. In the case of the bucket 21, hydraulic actuator 25 transfers force and movement to the bucket 21 through a coupler link 35. The coupler link 35 pivots about axis 31 of pin 33 and carries the bucket 21.

In the case of the thumb 23, hydraulic actuator 27 acts through progressive links 37, 38 which are, in turn, connected to the dipper stick 13 and the thumb 23 respectively. The thumb 23 also pivots about the common axis 31. In this manner, both the bucket 21 and the thumb 23 pivot about the same axis 31, both parts 21, 23 pivot in a common arc 41.

Since there are different arrangements for attachments to dipper sticks, it is contemplated that in some cases, the counter-articulating parts, if any, may be directly coupled to the hydraulic actuator 27 without the use of the progressive links 37, 38. It is also contemplated that a counter-articulating part corresponding to thumb 23 will be positioned to respond to the same actuator 25 as its opposing part corresponding to bucket 21. It is also contemplated that in many cases, the counter-articulating part will be partly responsive to movements of its opposing part.

In the case of the embodiments shown, the bucket 21 is carried in a fixed relationship with carrier link 35. This allows the bucket 21 to follow the movement of carrier link 35 by simply attaching the bucket 21.

Figure 2:
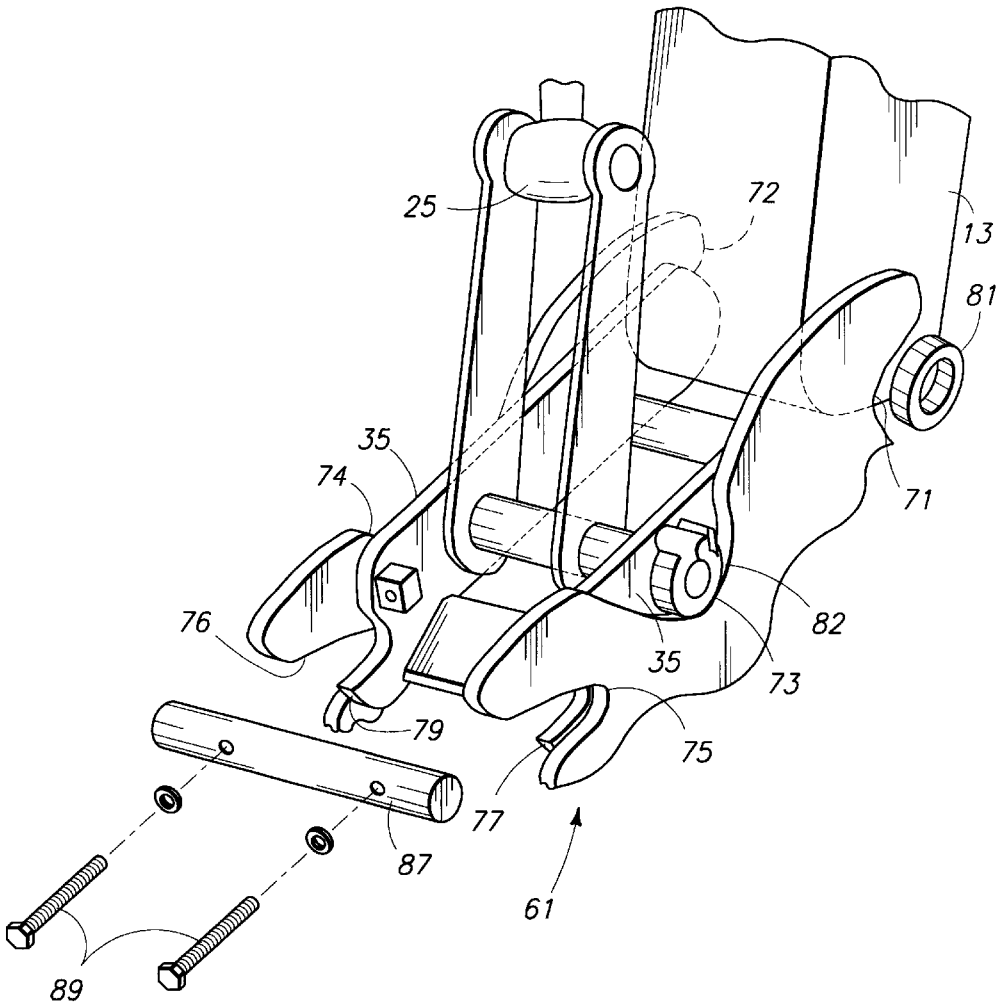
FIG. 2 shows an expanded view of a coupling arrangement with the bucket in position.

Referring to FIG. 2, an implement 61 is attached to dipper stick 13 by a plurality of slots 71–76 on the implement 61. a pair of fixed mounted pins 81, 82 cooperate with slots 71–74, so that the dipper stick 13 and hydraulic actuator 25 can be used to position the carrier link 35 with respect to the slots 71–74 on the implement 61. After the carrier link 35 is so positioned, a removable pin 87 is bolted to the carrier link 35 with bolts 89. The removable pin 87 thus retains the implement 61 on the dipper stick 13 by fixing the implement 61 to the carrier link 35.

Figure 3:
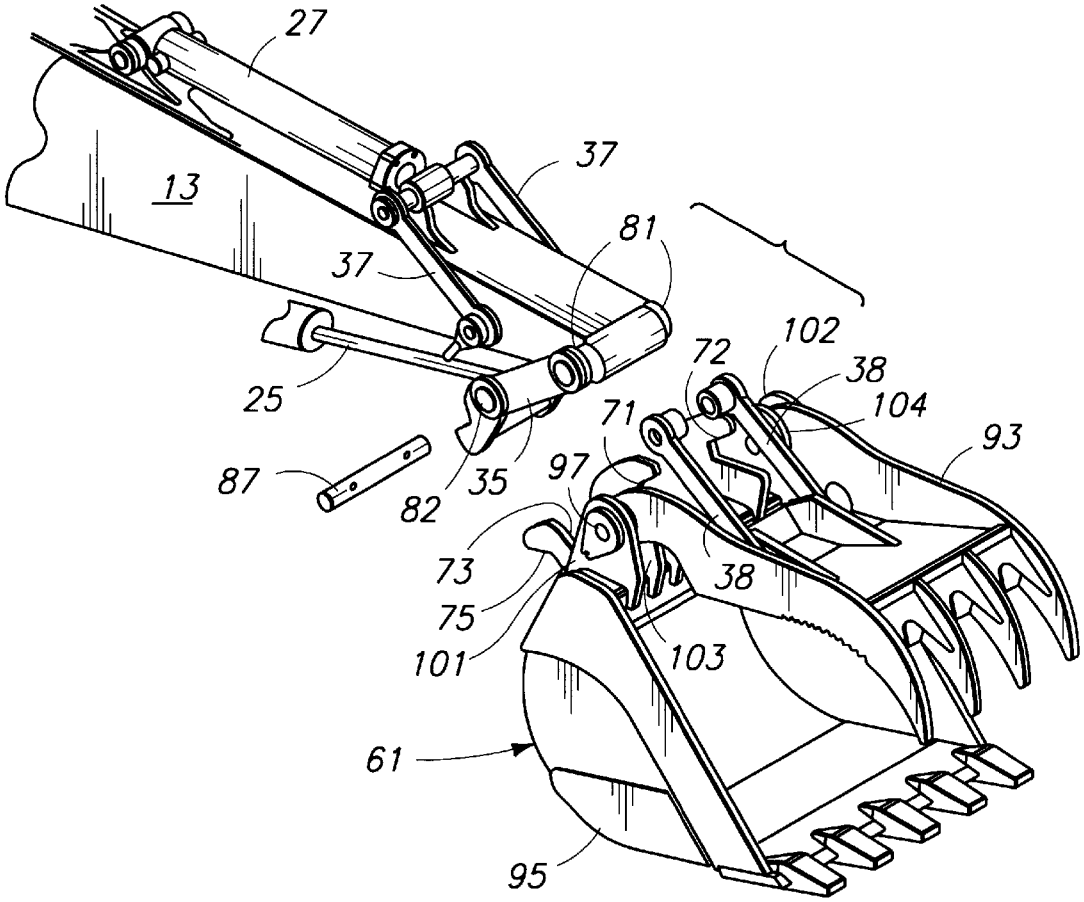
FIG. 3 shows an expanded view of the dipper stick and bucket arrangement of FIG. 2, with the bucket and thumb arrangement separated from the dipper stick.
Figures 4, 5, 6:
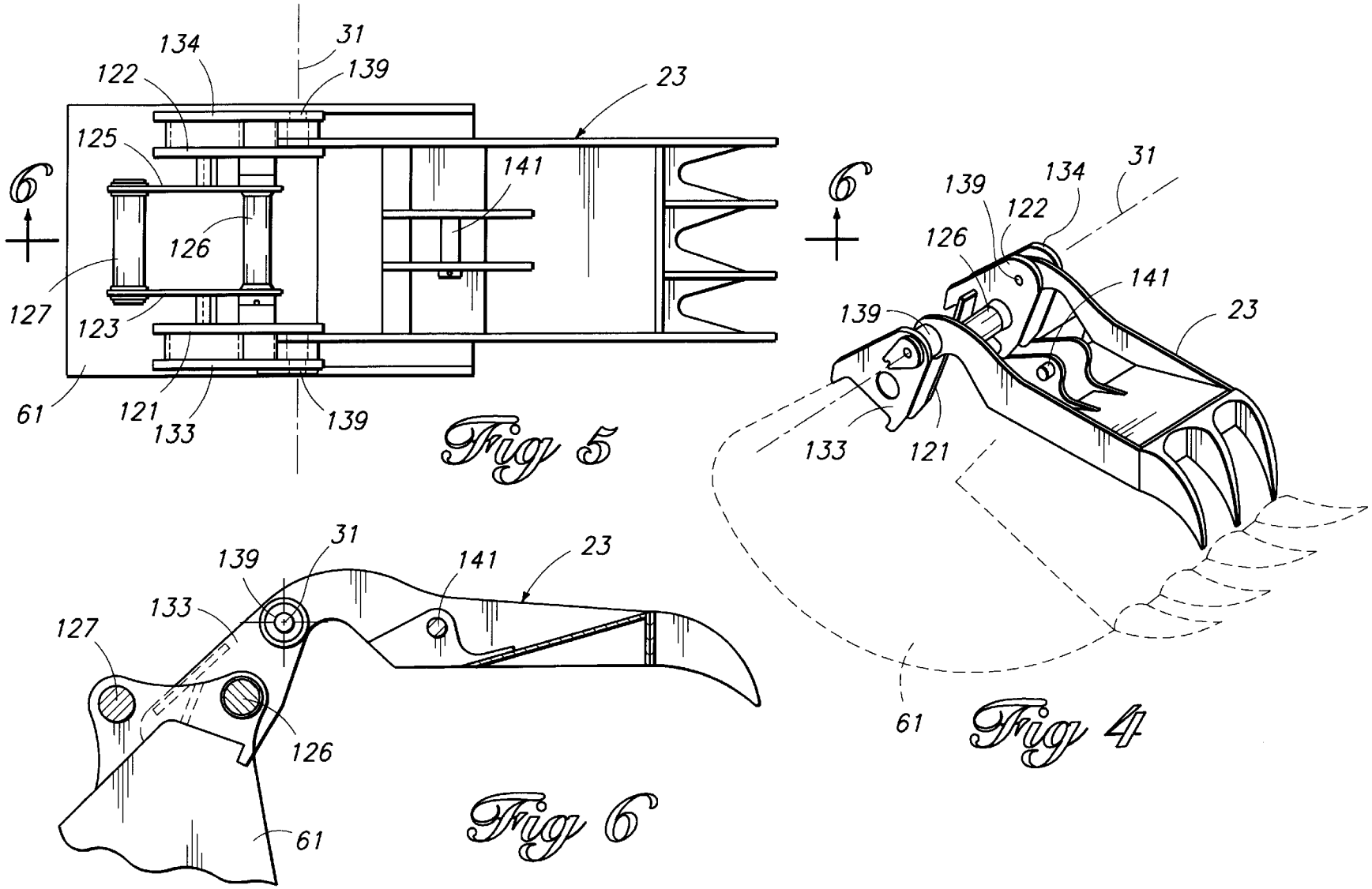
FIGS. 4–6 show details of the inventive coupling arrangement, used with a two pin configuration.

Referring to FIG. 3, the implement 61 carries a counter-articulating thumb 93, which is mounted to a bucket part 95 and pivots about a pivot pin point 97. The bucket part 95 is fixed to the slots 71–76 (FIG. 2). Thus, the bucket part 95 pivots about pin 81, along with the carrier link 35.

The thumb 93 pivots about a different pivot axle; that is, pin 97. Pin 97 is substantially co-axial with pin 81. As a result, the thumb 93 is articulated co-axially with the bucket part 95. By connecting progressive link 38 to hydraulic actuator 27, the thumb part 93 can further be controlled by actuator 27.

Pin 97 is supported by flanges 101 and 103. Likewise, the other side of the thumb 93 is supported by a pin (not shown) between flanges 102 and 104. In this manner, the thumb 93 is supported by the implement 61 and need not be separately picked up by the dipper stick 13. It is necessary to attach the thumb 93 to the actuator (through progressive link 38), but this can be accomplished more readily once the dipper stick 13 is attached to the implement 61 and, consequently, to the thumb 93. Pin 81 extends through coupler 35 and the dipper stick 13 and provides a pivot support for the implement 61 through coupler 35. Pin 81 is substantially co-axial with the pins (pin 97 and a pin extending between flanges 102 and 104), so that articulation of the thumb 93 is co-axial with articulation of the bucket 61. Therefore, articulation of the thumb 93 can be easily controlled by actuator 27 separately from articulation of the implement 61, as controlled by actuator 25.

Moreover, since attachment of the dipper stick 13 to the coupler 33 does not require separation of pin 81 from the implement 61 and thumb 93, it is possible to attach the implement 61 without dismantling the linkage between the thumb 93 and the implement 61.

Significantly, removal of implement 61 and thumb 93 consists of disconnecting progressive link 38 and removal of pin 87 by means of a quick coupling device. At that time, actuator 25 may be retracted. This allows easy removal of the combined attachment 61 and 93.

While a specific embodiment of the invention using a particular dipper stick 13 and pin arrangement 81, 83, 87 have been described, it is possible to implement the invention with different configurations of pins and slots. It is also possible to retain an implement on a carrier by fasteners other than the pin and bolt arrangement 87, 89. For example, the implement 61 can be directly bolted to the carrier after slots 71–74 are engaged. Since actuator 27 is separately operable, it is possible to include a quick disconnect for connecting the opposing element (thumb 93 in FIG. 3) to its actuator 27.

As mentioned, it is intended that a wide variety of implements be used in connection with the invention; otherwise, there would be reduced utility in being able to couple and decouple the implement 61 from the dipper stick 13.

It is also possible to implement the invention in connection with other arm and carrier arrangements. There are several techniques for achieving a quick disconnect capability and it is intended that the invention be adaptable to these. It is contemplated that the invention will be implemented for use with a coupling arrangement in which a hitch is received by slots and one of the pins is engaged by a latch. The hitch comprises a pair of pins 126, 127 mounted on the implement by flanges 123, 125. The first pin 126 provides a pivot axis for the implement. The second pin 127 is also engaged by slots in the coupler and may be engaged by a latch (not shown).

A configuration for accepting such a coupling arrangement is shown in FIGS. 1 and 4–6. In the embodiment of FIGS. 2 and 3, a first pair of slots 71, 72 in flanges extending outwardly from the bucket 61 engage a pivot pin 81 on the end of a dipper stick 13. A second set of slots 73, 74 in the flanges engage a pin 82 extending from the carrier link 35. These engagements prevent relative movement between the carrier link 35 and the bucket 61 in substantially all but one direction. A third pair of slots 75, 76 in the flanges are positioned past a corresponding pair of flanges 77, 79 on the carrier link 35. A removable pin 87 is bolted into place into the bight created by these corresponding flange slots 75, 77 and 76, 79. The thumb support pivots about pivot axes defined by pins 139 supported by flanges or "ears" 121, 122, 133, 134. The bucket is caused to pivot about a pivot axis which is reasonably close to the pivot axis defined by pins 139, so that the thumb is able to be operated substantially independently of the operation of the bucket. Actuator attachment pin 141 is used to separately control the pivotal movement of the thumb support 137, and consequently, the thumb.

The illustrated embodiments are only examples of the present invention and, therefore, are non-limitive. It to be understood than many changes in the particular structure, materials and features of the invention may be made without departing from the spirit and scope of the invention. Therefore, it is my intention that my patent rights not be limited by the particular embodiments illustrated and described herein, but rather determined by the following claims, interpreted according to accepted doctrines of claim interpretation, including use of the doctrine of equivalents and reversal of parts.

What is claimed is:

1. A two-part implement combination for attachment to an excavator arm, comprising:

a releasable quick coupling mechanism pivotably attached to the excavator arm and actuated for pivotal movement relative to the arm about a first axis;

a first implement part attachable to the arm by the releasable quick coupling mechanism for pivotal movement relative to the arm about the first axis;

a second implement part pivotally attached to the first implement part for independently-actuated pivotal movement relative to the first implement part and the arm about an axis substantially co-extensive with the first axis.

2. The combination of claim 1, in which an actuator for movement of the second implement part is operably attached thereto.

3. The combination of claim 1, further comprising a pair of mounting flanges extending outwardly from the first implement part to provide a location of pivotal attachment between the first and second implement parts that is substantially axially aligned with the first axis, said extension flanges being situated outboard of the pivotal attachment between the releasable quick coupling mechanism and the excavator arm.

4. The combination of claim 1, wherein the first implement part comprises an excavator bucket and the second implement part comprises an opposable thumb member.

5. The combination of claim 1, wherein the releasable quick coupling mechanism comprises a pair of substantially parallel, spaced-apart mounting pins and the first implement part includes a pair of slots corresponding to the pins, the slots having openings directed substantially perpendicularly away from one another.

6. The combination of claim 1, wherein the releasable quick coupling mechanism comprises a pair of engagement slots having openings directed substantially perpendicularly relative to one another and engageable with a pair of substantially parallel, spaced-apart attachment pins mounted on the first implement part.

* * * * *